US005417037A

United States Patent [19]

Osti et al.

[11] Patent Number: 5,417,037

[45] Date of Patent: May 23, 1995

[54] METHOD AND MACHINE FOR PRODUCING DOUBLE PACKETS OF CIGARETTES

[75] Inventors: Roberto Osti, Zola Predosa; Alessandro Minarelli, Bologna, both of Italy

[73] Assignee: G. D. Societa' Per Azioni, Bologna, Italy

[21] Appl. No.: 199,830

[22] Filed: Feb. 22, 1994

[30] Foreign Application Priority Data

Feb. 23, 1993 [IT] Italy ..... BO93A0061

[51] Int. Cl.[6] ..... B65B 35/30

[52] U.S. Cl. ..... 53/446; 53/234; 53/544; 198/374; 198/377

[58] Field of Search ..... 53/143, 202, 234, 446, 53/544; 198/374, 377, 379, 418.1

[56] References Cited

U.S. PATENT DOCUMENTS

| | | | |
|---|---|---|---|
| 3,563,377 | 2/1971 | Southcott | 198/377 X |
| 4,258,528 | 3/1981 | Focke | 53/202 X |
| 4,509,310 | 4/1985 | Focke et al. | 53/234 X |
| 4,672,795 | 6/1987 | Alexander et al. | 53/446 |
| 4,883,163 | 11/1989 | Gamberini et al. | 198/460 |
| 5,046,295 | 9/1991 | Knecht | 53/202 |
| 5,085,028 | 2/1992 | Boriani et al. | 53/234 |
| 5,090,553 | 2/1992 | Focke | 198/377 |
| 5,188,212 | 2/1993 | Munsch | 198/377 X |

*Primary Examiner*—John Sipos
*Assistant Examiner*—Daniel Moon
*Attorney, Agent, or Firm*—Marshall, O'Toole, Gerstein, Murray & Borun

[57] ABSTRACT

A method and machine whereby a first and second rigid packet are fed in a first direction parallel to the longer longitudinal axes of the packets; are transferred to the input of respective feed channels, the second packet being rotated 180° in relation to the first; are fed at different speeds along the respective channels, in a second direction perpendicular to their longer longitudinal axes, until they are positioned coaxial but axially spaced in relation to each other; the end wall of one of the two packets is gummed; and the packets are brought together so that the end walls adhere to each other, thus forming a double packet.

22 Claims, 5 Drawing Sheets

METHOD AND MACHINE FOR PRODUCING DOUBLE PACKETS OF CIGARETTES

The present invention relates to a method of producing double packets of cigarettes.

SUMMARY OF THE INVENTION

It is an object of the present invention to provide a straightforward, low-cost method of connecting packets of cigarettes coaxially and oppositely in pairs for forming double packets for supply to a production machine, e.g. a cellophaning machine.

According to the present invention, there is provided a method of producing double packets of cigarettes, each packet comprising two oppositely-aligned single packets with respective end walls connected integral with each other; and the method being characterized by the fact that it comprises stages consisting in feeding the single packets in an orderly succession and in a first direction parallel to the longer longitudinal axes of the single packets; transferring each pair of adjacent single packets in said succession to the input of respective feed channels, and rotating a second single packet in each said pair 180° in relation to a first single packet in the same pair; feeding said two single packets along respective said channels at different speeds and in a second direction perpendicular to the respective longer longitudinal axes, so that the two single packets are positioned coaxially but axially spaced in relation to each other; gumming the end wall of at least one of said two single packets; and bringing said two single packets together by moving them along the longer longitudinal axis, so that the respective end walls adhere to each other to form a respective said double packet.

The present invention also relates to a machine for producing double packets of cigarettes.

According to the present invention, there is provided a machine for producing double packets of cigarettes, each packet comprising two oppositely-aligned single packets with respective end walls connected integral with each other; and the machine being characterized by the fact that it comprises first conveyor means for feeding the single packets in an orderly succession and in a first direction parallel to the longer longitudinal axes of the single packets; a first and second channel located substantially side by side, for feeding respective single packets in a second direction perpendicular to the respective said longer longitudinal axes; transfer means for transferring a first and second single packet in each pair of adjacent single packets in said succession from the first conveyor means to the input of the first and second channel respectively, said transfer means comprising gripping means for successively gripping said single packets and rotating the second single packet in each said pair 180° in relation to the respective first single packet; second and third conveyor means for successively feeding said first and, respectively, said second single packets along said first and second channels at different speeds and in said second direction, so that the two single packets in each said pair are positioned coaxially but axially spaced in relation to each other; gumming means for gumming the end wall of at least one of said two single packets; and compacting means located downstream from said channels in said second direction, for bringing said two single packets axially together, so that the respective end walls adhere to each other for forming a respective said double packet.

BRIEF DESCRIPTION OF THE DRAWINGS

A number of non-limiting embodiments of the present invention will be described by way of example with reference to the accompanying drawings, in which.

DETAILED DESCRIPTION OF THE INVENTION

Figure 1:
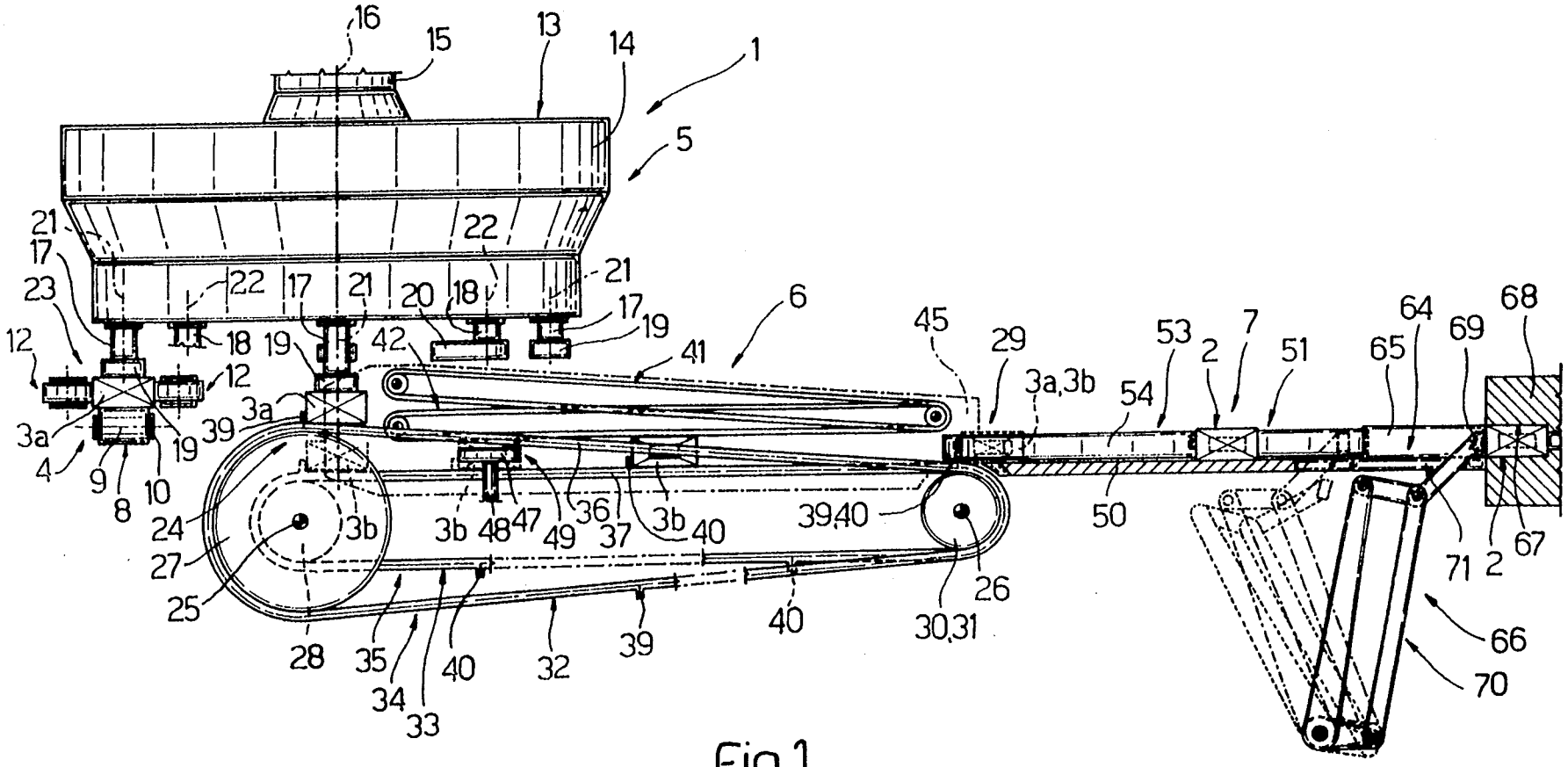
FIG. 1 shows a partially sectioned side view, with parts removed for clarity, of a first preferred embodiment of the machine according to the present invention.

Number 1 in FIG. 1 indicates a machine for producing double packets 2, each comprising two single rigid hinged-lid packets 3 oppositely-coaxial and integral with each other at the end walls facing and contacting each other.

Figure 2:
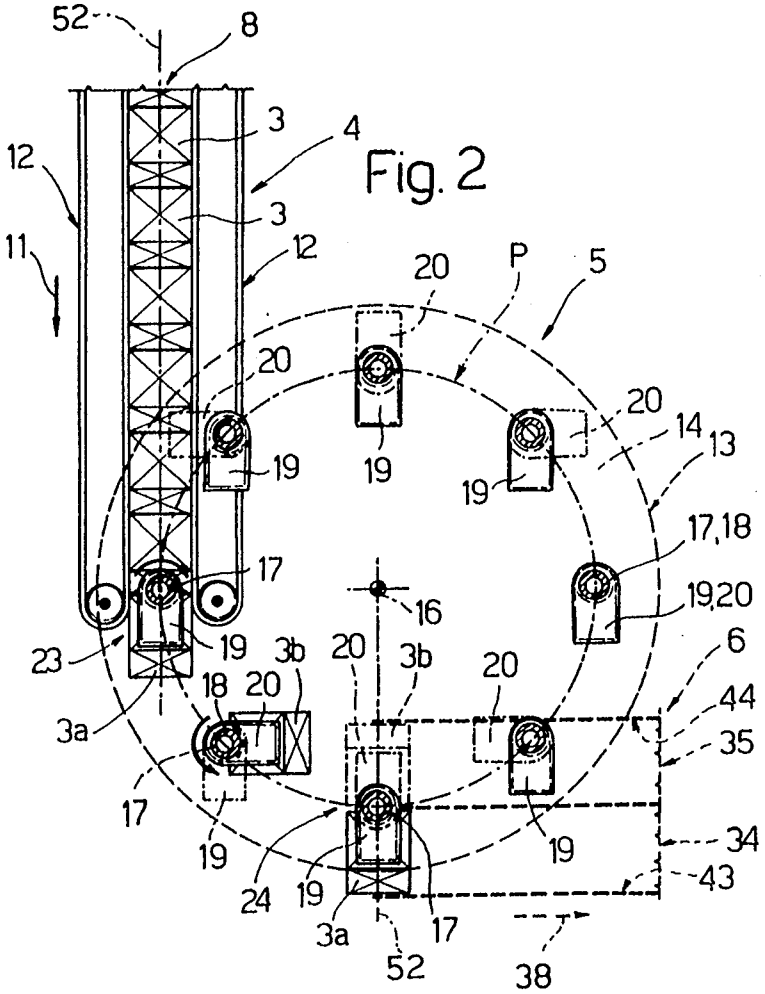
FIG. 2 shows a partially sectioned plan view, with parts removed for clarity, of a first detail of the FIG. 1 machine.
Figure 3:
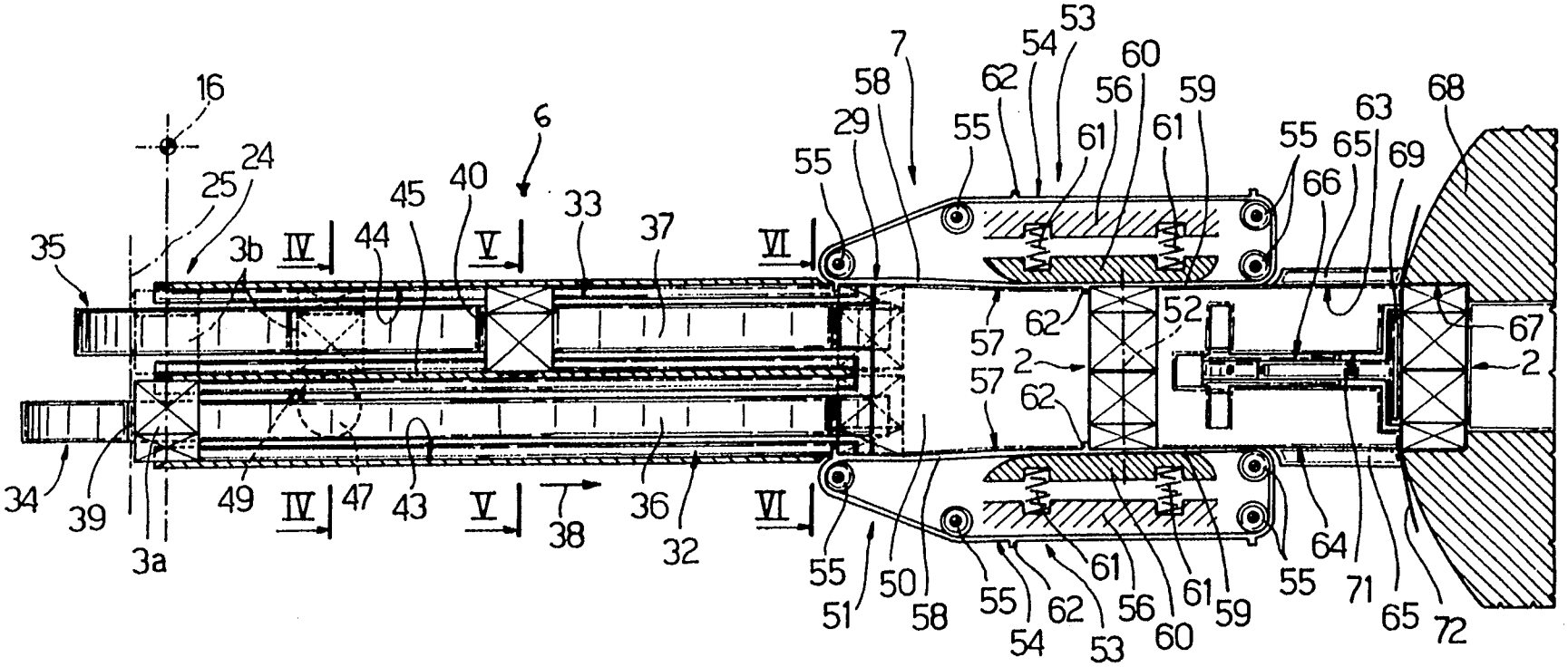
FIG. 3 shows a plan view, with parts removed for clarity, of a second detail of the FIG. 1 machine.

Machine 1 comprises an input portion 4 (shown in more detail in FIG. 2); an intermediate transfer portion (FIGS. 1 and 2); an output portion 6 (FIGS. 1 and 3); and an assembly portion 7 (FIGS. 1 and 3).

With reference to FIGS. 1 and 2, input portion 4 comprises a substantially horizontal conveyor 8 defined by an endless belt 9 looped about pulleys 10 (only one shown), and which provides for conveying, in a first substantially horizontal direction. 11, a continuous succession of equioriented packets 3 laid flat, contacting one another, with their lids facing frontwards. Packets 3 are maintained in line with one another on conveyor 8 by two lateral conveyors 12 located on either side of conveyor 8 and over the top transportation branch of belt 9.

Again with reference to FIGS. 1 and 2, intermediate transfer portion 5 comprises a known carousel conveyor 13 substantially of the type described in U.S. Pat. No. 4,883,163, and which comprises a revolving head 14 rotated anticlockwise (in FIG. 2) about a substantially vertical axis 16 by a central drive shaft 15. At the bottom, conveyor 13 presents two numbers of output shafts 17 and 18 equally spaced about axis 16 and which rotate about axis 16 with head 14. On the bottom ends, shafts 17 and 18 present respective suction type gripping heads 19 and 20, and are rotated about their respective axes 21 and 22, parallel to axis 16, at the same angular speed at which head 14 is rotated by shaft 15, and by a known epicyclic drive (not shown) housed inside head 14 between shaft 15 and shafts 17 and 18.

More specifically, and as shown schematically in FIG. 2, shafts 17 rotate about respective axes 21 in the opposite direction to that of head 14 so that, by virtue of the combined rotation of head 14 and of shafts 17 about axes 21, suction heads 19 are maintained parallel to themselves and to direction 11 at all times. Conversely, shafts 18 rotate about respective axes 22 in the same direction as head 14 so that, by virtue of the combined rotation of head 14 and of shafts 18 about axes 22, suction heads 20 make two turns, in relation to an external reference, anticlockwise (in FIG. 2) about respective axes 22 for each turn of head 14 about axis 16.

Each of shafts 17 and 18 is connected in known manner to known actuating means (not shown) housed inside head 14, and which provide for moving respective shaft 17, 18 axially between a raised idle position and lowered operating position. As head 14 is rotated, suction heads 19 and 20 (to be more precise, respective axes 21 and 22) travel along a substantially circular path P through a pickup station 23 at the output end of conveyor 8, and wherein direction 11 is substantially tangent to path P; and through an unloading station 24 at the input end of output portion 6, and located 90° downstream from station 23 along path P in the rotation direction of head 14.

Finally, as shown in FIG. 2, conveyor 8 is so timed in relation to conveyor 13 as to feed a packet 3 into station 23 simultaneously with the passage through station 23 of a suction head 19, 20; and suction heads 20 are so timed in relation to suction heads 19 as to be arranged facing the same way as heads 19 at station 23, and, consequently, the opposite way to heads 19 at station 24. In other words, as they travel through station 23, both suction heads 19 and 20 are substantially tangent to path P and face forward in relation to respective shafts 17 and 18; whereas, through station 24, they are positioned radially outwards and inwards respectively of path P.

As shown in FIGS. 1 and 3, output portion 6 of machine 1 comprises two shafts 25 and 26 parallel to each other and to direction 11. Shaft 25 is a drive shaft located beneath conveyor 13, substantially at station 24, and fitted with two pulleys 27 and 28; while shaft 26 is a driven shaft located at a transfer station 29 at the output of portion 6 and the input of portion 7 of machine 1, and is fitted with two identical pulleys 30 and 31 aligned respectively with pulleys 27 and 28.

Pulley 27 is located directly beneath the path of suction heads 19 through station 24; while pulley 28 is located directly beneath the path of suction heads 20 through station 24, and presents a periphery equal to half that of pulley 27. Drive shaft 25 is rotated clockwise (in FIG. 1) at such an angular speed that the surface speed of pulley 28 is greater than the traveling speed of suction heads 19 and 20 along path P, and equal to half the surface speed of pulley 27.

Pulleys 27, 30 and pulleys 28, 31 support respective endless belts 32 and 33 of two side by side conveyors 34 and 35, the transportation branches 36 and 37 of which extend between stations 24 and 29 in a direction 38 (FIG. 3) perpendicular to direction 11. Due to the different surface speeds of pulleys 27 and 28, belt 32 travels at twice the speed of belt 33.

Externally, belts 32 and 33 present respective numbers of equally spaced, outwardly-projecting push appendixes 39 and 40. Appendixes 39 are equally spaced along belt 32 by a distance equal to twice that of appendixes 40; and conveyors 34 and 35 are so timed in relation to each other and to conveyor 13 that the passage of an appendix 39 through station 24 corresponds with the simultaneous passage through station 24 of an appendix 40 and a packet 3—hereinafter referred to as packet 3*a*—gripped by a suction head 19 on conveyor 13; while the passage through station 24 of an intermediate appendix 40 between two adjacent appendixes 39 corresponds with the simultaneous passage through station 24 of a packet 3—hereinafter referred to as packet 3*b*—gripped by a suction head 20 on conveyor 13.

Appendixes 39 and 40 provide for successively feeding respective packets 3*a* and 3*b* along respective paths: one defined between branch 36 of conveyor 34 and the bottom branch of an endless hold conveyor 41 over the portion of branch 36 extending downstream from station 24 in direction 38; and the other defined between branch 37 of conveyor 35 and the bottom branch of an endless hold conveyor 42 over the portion of branch 37 extending downstream from station 24 in direction 38.

Figure 4:
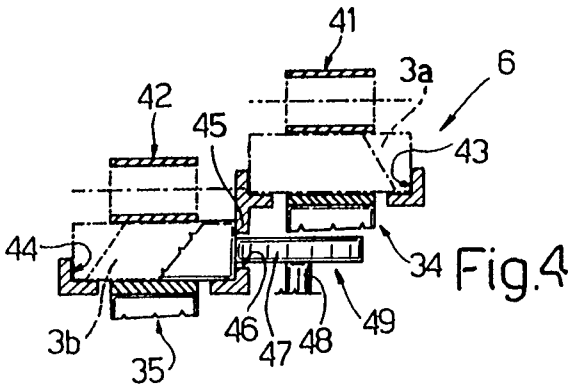
FIGS. 4, 5 and 6 show respective sections along lines IV—V, V—V and VI—VI in FIG. 3.
Figure 5:
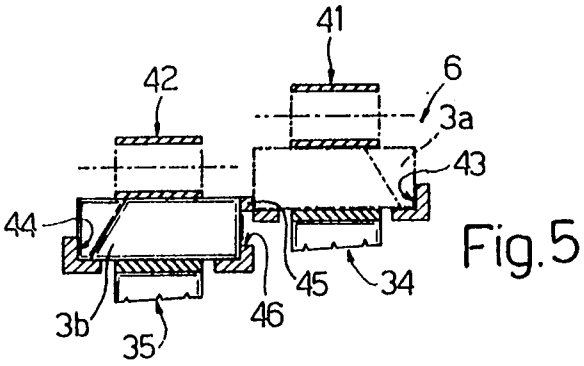
Figure 6:
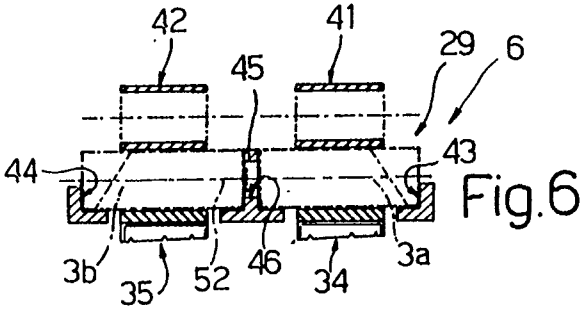

As shown in FIGS. 4, 5 and 6, packets 3*a* and 3*b* are fed by respective branches 36 and 37 along respective channels 43 and 44. Channel 44 is substantially horizontal, whereas channel 43 slopes downwards towards station 29 and is separated at all times from channel 44 by an intermediate vertical wall 45 perpendicular to shafts 25 and 26. Wall 45 presents an opening 46 extending parallel to branch 37, between branch 37 and respective hold conveyor 42, and narrower than the thickness of packets 3. Opening 46 is engaged by a known gumming roller 47 mounted for rotation on a vertical shaft 48 beneath branch 36 and at a gumming station 49 between stations 24 and 29 and close to station 24.

As shown in FIG. 3, assembly portion 7 comprises a fixed plate 50 substantially coplanar with branch 37, and the input end of which is arranged facing the side by side output ends of branches 36 and 37; and a compacting device 51 which provides for feeding, in direction 38, pairs of packets 3*a* and 3*b* oppositely aligned along a common axis 52 perpendicular to direction 38 and coinciding with the longer longitudinal axis of packets 3*a* and 3*b*, and for bringing packets 3*a* and 3*b* together along axis 52 so that the respective end walls contact each other.

Device 51 comprises two conveyors 53 located on either side of plate 50, and each presenting a belt 54 looped about a number of pulleys 55 mounted on a fixed frame 56 and having axes perpendicular to the plane of plate 50. Each belt 54 comprises a transportation branch 57 extending in a direction substantially parallel to direction 38, and which presents a first free portion 58, and a second portion 59 downstream from portion 58 in direction 38 and mounted in sliding contact with a shoe 60 which is moved horizontally and perpendicularly to direction 38 by a number of springs 61 between shoe 60 and frame 56. On the side facing the other belt 54, each belt 54 presents a number of equally spaced appendixes 62; and one of pulleys 55 is a drive pulley for operating belt 54 at a traveling speed at least equal to that of branch 37 of belt 33. Belts 54 are timed in relation to each other and belts 32 and 33 so that respective appendixes 62 travel through station 29 simultaneously with two packets 3*a* and 3*b* oppositely aligned along respective axis 52.

Assembly portion 7 also comprises an outlet 63 defined, on end portion 64 of plate 50, by two fixed walls 65 perpendicular to and on either side of plate 50, and separated by a distance approximately equal to but no less than twice the length of packet 3; and a push device 66 for successively feeding double packets 2—consisting of pairs of aligned, connected packets 3*a* and 3*b*—a-long end portion 64 and into respective peripheral seats 67 on a known overwrapping wheel 68.

As shown in FIG. 1, push device 66 comprises an operating head 69 which is moved by a known actuating device 70, in the form of an articulated parallelogram, along an opening 71 provided in an end portion 64 in a direction parallel to direction 38, and along a substantially elliptical path comprising a thrust portion along which head 69 moves over plate 50 towards wheel 68 for feeding packet 2 into respective seat 67, and a return portion along which head 69 moves beneath plate 50 towards station 29.

In actual use, packets 3, aligned along conveyor 8 with longitudinal axes 52 parallel to direction 11 and the lids facing forward in direction 11, are fed in an orderly succession and substantially contacting one another to pickup station 23, each simultaneously with a suction head 19, 20; and below, operation of machine 1 will be described as of the instant in which a packet **3*b* reaches station 23 together with a respective head 20**.

Upon packet **3*b* reaching station 23, respective head 20, traveling along path P at a speed greater than the traveling speed of conveyor 8, catches up with packet 3*b* and moves down to grip and remove it off conveyor 8. As already stated, when traveling through station 23, head 20 is substantially parallel to direction 11 and axis 52 of respective packet 3*b*, and travels in a direction parallel to direction 11**.

On removing packet **3*b* off conveyor 8, head 20 moves up and travels anticlockwise (in FIG. 2) along a 90° arc of path P before reaching unloading station 24. In the course of this movement, head 20, if devoid of motion in relation to head 14 of conveyor 13, would remain substantially tangent to path P; whereas, being designed to rotate about its axis 22 in relation to, in the same direction as, and at the same angular speed as head 14, head 20, as it travels along the 90° arc between stations 23 and 24, is rotated 90° in relation to head 14 as of its former position tangent to path P, so that, at station 24, it is positioned radially inwards of path P, with the lid of packet 3*b* facing axis 16**.

As shown in FIG. 1, at station 24, head 20 moves down to deposit packet **3*b* on to conveyor 35, with axis 52 perpendicular to the traveling direction 38 of conveyor 35, and with packet 3*b* engaged by a push appendix 40**.

The distance between stations 24 and 29 and the speed of conveyor 35 are such that packet **3*b* is halfway along conveyor 35 in the direction of station 29 when a packet 3*a* is deposited by respective head 19 on to conveyor 34 in station 24 and engaged by a respective push appendix 39. As it travels in direction 38 along respective channel 44, packet 3*b* is fed through station 49 where its end wall facing channel 43 comes into contact with roller 47 by which a layer of gum is applied to a portion of said end wall, corresponding with opening 46 along the whole length of channel 44. Together with wall 45, opening 46 prevents the adhesive material from fouling channel 44, and the gummed portion of the end wall of packet 3*b* from coming into contact with a corresponding packet 3*a* as it travels along channel 44**.

The fact that transportation branch 37 of conveyor 35 slopes less than transportation branch 36 of conveyor 34 enables roller 47 to be set up in a fixed position beneath the initial portion of branch 36.

In connection with packet **3*a* mentioned previously, it should be pointed out that this is conveyed by respective head 19 between stations 23 and 24 traveling parallel to itself and to direction 11, so that it is unloaded in station 24 when the corresponding packet 3*b* is halfway to station 29, and, like packet 3*b*, is positioned radially in relation to path P but with its lid facing outwards of axis 16**.

As conveyor 34 travels at twice the speed of conveyor 35, both packets **3*a* and 3*b* reach station 29 simultaneously and at the instant in which a further packet 3*b* is deposited on to conveyor 35 in station 24. On reaching plate 50, packets 3*a* and 3*b* are oppositely coaxial with each other, and are immediately pushed into contact with each other by portions 58 of transportation branches 57 of belts 54 of conveyors 53 of compacting device 51 which, in addition to simultaneously feeding packets 3*a* and 3*b* in direction 38, also provides for gradually pressing them together along axis 52 so as to bond the end walls and so form a double packet 2 before packets 3*a* and 3*b* reach the output end of compacting device 51 and are engaged by head 69 of push device 66**.

On engaging packet 2, head 69 pushes it into a respective seat 67 on wrapping wheel 68 which, in the example shown, consists of the wrapping head of a cellophaning machine of the type described in U.S. Pat. No. 5,085,028, i.e. of the type designed to wrap each product, housed inside a respective peripheral seat, in a single sheet 72 of transparent overwrapping material. Consequently, packets **3*a* and 3*b* constituting packet 2 are both wrapped in the same sheet 72**.

Figure 7:
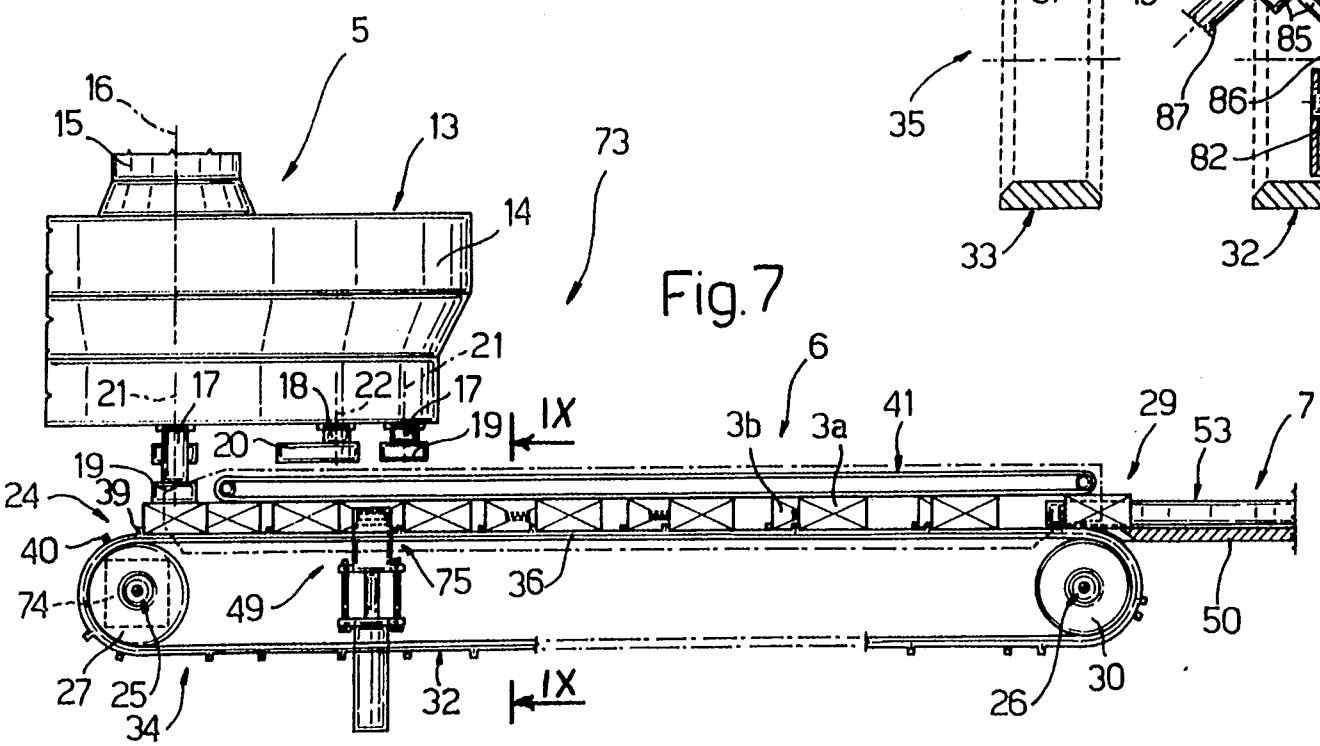
FIG. 7 shows a partially sectioned side view, with parts removed for clarity, of a second preferred embodiment of the machine according to the present invention.
Figure 9:
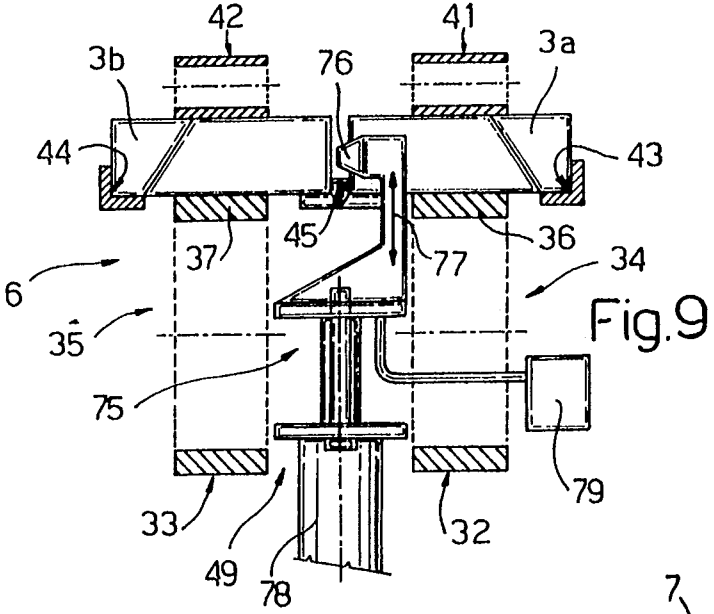
FIG. 9 shows a section along line IX—IX in FIG. 7.
Figure 8:
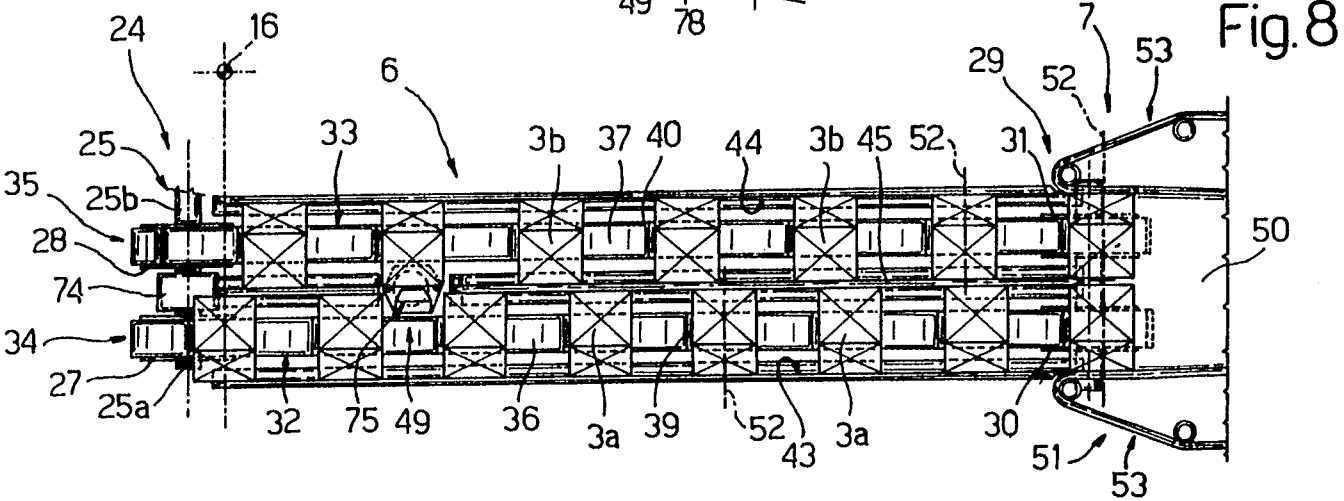
FIG. 8 shows a plan view, with parts removed for clarity, of a detail of the FIG. 7 machine.

The embodiment shown in FIGS. 7 to 9 relates to a machine 73 which substantially differs from machine 1 by presenting substantially identical conveyors 34 and 35. More specifically, pulleys 27 and 28 of machine 73 are identical; and transportation branches 36 and 37 are coplanar and arranged side by side to enable the same vertical travel of heads 19 and 20 for depositing respective packets **3*a* and 3*b* on to branches 36 and 37 at station 24**.

As shown particularly in FIG. 8, drive shaft 25 of machine 73 is divided into two parts **25*a* and 25*b* fitted respectively with pulleys 27 and 28 and connected to each other by a reduction gear 74. This is designed to operate belt 32 at a greater speed than belt 33, and such that, if S is the spacing of packets 3*b* on transportation branch 37, and "n" the number of packets 3*b* between stations 24 and 29, in the time taken for transportation branch 37 to cover a distance of $S(n-1)$, transportation branch 36 covers a distance of $S(n-\frac{1}{2})$. Consequently, a packet 3*a* formerly offset by S/2 in relation to a corresponding packet 3*b* at station 24 is positioned with its axis 52 coaxial with that of corresponding packet 3*b* at station 29**.

As shown in FIG. 9, at gumming station 49, roller 47 of machine 1 is replaced by a gumming device 75 comprising a spray nozzle 76 located between conveyors 34 and 35 and moved back and forth, in direction 77 perpendicular to the plane of branches 36 and 37, by an actuator 78. Nozzle 76 provides for spraying adhesive material, supplied by a pump 79, on to the end wall of packets **3*b*, and is dropped down by actuator 78 beneath the plane of transportation branches 36 and 37 to avoid interfering with the incoming packet 3*a* on branch 36**.

Figure 10:
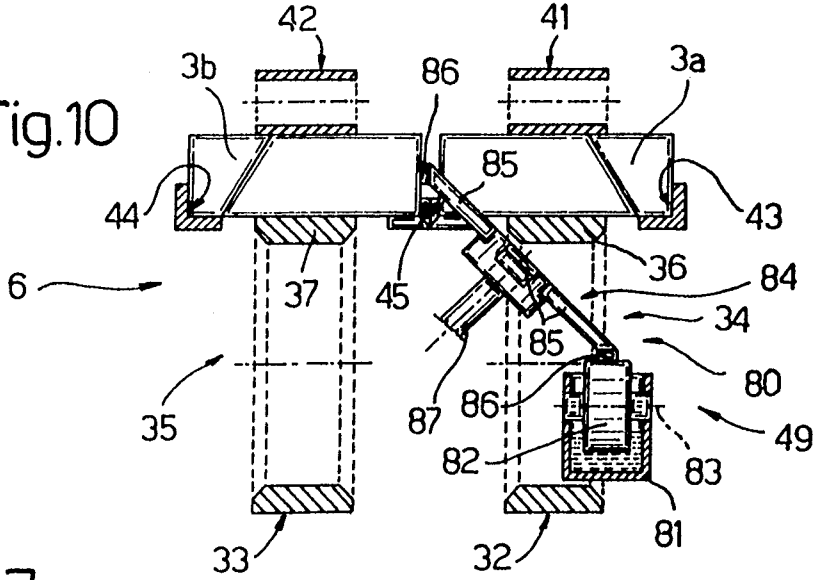
FIG. 10 shows the same section IX—IX of a variation of the FIG. 9 detail.

In the variation shown in FIG. 10, gumming device 75 is replaced by a gumming device 80 comprising a tank 81 for adhesive material; a gumming roller 82 partially immersed in the adhesive material in tank 81, and supported on tank 81 so as to rotate about a horizontal axis 83; and a gumming wheel 84 in turn comprising four diametrically opposed lobes 85, each with a gumming pad 86 on the end. Wheel 84 is located beneath the initial portion of branch 36, and is fitted to an inclined drive shaft 87 located in a plane perpendicular to branches 36, 37, and which provides for so rotating wheel 84 as to avoid interference with packets 3*a*, while at the same time causing each pad 86 to cooperate first with the outer surface of roller 82 and then with the end wall of packets 3*b*.

We claim:

1. A method of producing double packets (2) of cigarettes, each packet (2) comprising two oppositely-aligned single packets (3*a*, 3*b*) with respective end walls connected integral with each other; and the method being characterized by the fact that it comprises stages consisting in feeding the single packets (3*a*, 3*b*) in an orderly succession and in a first direction (11) parallel to the longer longitudinal axes (52) of the single packets (3*a*, 3*b*); transferring each pair of adjacent single packets (3*a*, 3*b*) in said succession to the input of respective feed channels (43, 44), and rotating a second single packet (3*b*) in each said pair 180° in relation to a first single packet (3*a*) in the same pair; feeding said two single packets (3*a*, 3*b*) along respective said channels (43, 44) at different speeds and in a second direction (38) perpendicular to the respective longer longitudinal axes (52), so that the two single packets (3*a*, 3*b*) are positioned coaxially but axially spaced in relation to each other; gumming the end wall of at least one of said two single packets (3*a*, 3*b*); and bringing said two single packets (3*a*, 3*b*) together by moving them along the longer longitudinal axis (52), so that the respective end walls adhere to each other to form a respective said double packet (2).

2. A method as claimed in claim 1, characterized by the fact that said single packets (3) are rigid, hinged-lid packets.

3. A method as claimed in claim 1, characterized by the fact that said second direction (38) is perpendicular to said first direction (11).

4. A method as claimed in claim 3, characterized by the fact that said first and second single packets (3*a*, 3*b*) are transferred to respective said channels (43, 44) by moving the first packet (3*a*) parallel to itself, and by rotating the second packet (3*b*) 180° about an axis (22) perpendicular to its own longer longitudinal axis (52) and to said first and second directions (11, 38).

5. A method as claimed in claim 4, characterized by the fact that said first and second single packets (3*a*, 3*b*) are transferred to respective said channels (43, 44) by feeding the single packets (3*a*, 3*b*) along a 90° arc about an axis (16) perpendicular to said first and second directions (11, 38).

6. A method as claimed in claim 4, characterized by the fact that the end wall of one (3*b*) of said single packets (3*a*, 3*b*) is gummed as the single packet (3*b*) travels along the respective said channel (44).

7. A method as claimed in claim 6, characterized by the fact that the end wall of said second packet (3*b*) is gummed.

8. A method as claimed in claim 1, characterized by the fact that it comprises a further stage consisting in feeding each double packet (2) into a seat (67) on an overwrapping wheel (68) for wrapping both the integral single packets (3*a*, 3*b*) of the double packet (2) in a single sheet (72) of overwrapping material.

9. A machine for producing double packets (2) of cigarettes, each packet (2) comprising two oppositely-aligned single packets (3*a*, 3*b*) with respective end walls connected integral With each other; and the machine (1; 73) being characterized by the fact that it comprises first conveyor means (8) for feeding the single packets (3*a*, 3*b*) in an orderly succession and in a first direction (11) parallel to the longer longitudinal axes (52) of the single packets (3*a*, 3*b*); a first and second channel (43, 44) located substantially side by side, for feeding respective single packets (3*a*, 3*b*) in a second direction (38) perpendicular to the respective said longer longitudinal axes (52); transfer means (13) for transferring a first and second single packet (3*a*, 3*b*) in each pair of adjacent single packets (3*a*, 3*b*) in said succession from the first conveyor means (8) to the input of the first (43) and second (44) channel respectively, said transfer means (13) comprising gripping means (19, 20) for successively gripping said single packets (3*a*, 3*b*) and rotating the second single packet (3*b*) in each said pair 180° in relation to the respective first single packet (3*a*); second and third conveyor means (34, 35) for successively feeding said first (3*a*) and, respectively, said second (3*b*) single packets along said first and second channels (43, 44) at different speeds and in said second direction (38), so that the two single packets (3*a*, 3*b*) in each said pair are positioned coaxially but axially spaced in relation to each other; gumming means (47; 75; 80) for gumming the end wall of at least one of said two single packets (3*a*, 3*b*); and compacting means (51) located downstream from said channels (43, 44) in said second direction (38), for bringing said two single packets (3*a*, 3*b*) axially together, so that the respective end walls adhere to each other for forming a respective said double packet (2).

10. A machine as claimed in claim 9, characterized by the fact that said second direction (38) is perpendicular to said first direction (11).

11. A machine as claimed in claim 10, characterized by the fact that said transfer means (13) comprise a carousel conveyor (13) in turn comprising a main head (14) rotating about a first axis (16) perpendicular to said first and second directions (11, 38); and a number of gripping heads (19, 20) for gripping said single packets (3); said gripping heads (19, 20) being equally spaced about said main head (14), and rotating, in relation to the main head (14), about respective second axes (21, 22) at an angular speed equal to that of the main head (14) about said first axis (16).

12. A machine as claimed in claim 11, characterized by the fact that, in each pair of adjacent said gripping heads (19, 20), a first gripping head (19) rotates about the respective second axis (21) in the opposite direction to that in which the main head (14) rotates about the first axis (16); and a second gripping head (20) rotates about the respective second axis (22) in the same direction as the main head (14) about the first axis (16).

13. A machine as claimed in claim 12, characterized by the fact that it comprises a pickup station (23) wherein said single packets (3*a*, 3*b*) are removed off said first conveyor means (8) by respective gripping heads (19, 20); and an unloading station (24) wherein the single packets (3*a*, 3*b*) are deposited respectively on to the second (34) and third (35) conveyor means; each said gripping head (19, 20) traveling, in use, along a 90° arc about the first axis (16) to pass from said pickup station (23) to said unloading station (24).

14. A machine as claimed in claim 13, characterized by the fact that said second (34) and said third (35) conveyor means extend between said unloading station (24) and a transfer station (29) for transferring the single packets (3*a*, 3*b*) to said compacting means (51), and comprise respective conveyor belts (34, 35) located side by side and substantially parallel to said second direction (38).

15. A machine as claimed in claim 14, characterized by the fact that said second (34) and said third (35) conveyor means present respective numbers of appendixes (39, 40) for pushing respective said single packets (3*a*, 3*b*); the speeds of the second (34) and third (35) conveyor means being such that, in the time taken by the third conveyor means (35) to move a respective push appendix (40) by a first distance equal to the distance between said unloading station and said transfer station, said second conveyor means (34) move a respective push appendix (39) by a second distance equal to the first distance minus half a space.

16. A machine as claimed in claim 14, characterized by the fact that said second (34) and third (35) conveyor means comprise respective belts (32, 33) in turn comprising respective transportation branches (36, 37) sloping differently towards said transfer station (29); the transportation branch (37) of said third conveyor means (35) sloping less than the transportation branch (36) of said second conveyor means (34), and extending through a gumming station (49) housing said gumming means (47).

17. A machine as claimed in claim 16, characterized by the fact that dividing wall means (45) are interposed between the second (34) and third (35) conveyor means; said dividing wall means (45) presenting an opening (46) extending parallel to the transportation branch (37) of the belt (33) of said third conveyor means (35); and said gumming means (47) engaging a portion of said opening (46).

18. A machine as claimed in claim 17, characterized by the fact that said gumming means (47) comprise a roller (47) to the side of the initial portion of said third conveyor means, and the periphery of which engages said opening (46).

19. A machine as claimed in claim 14, characterized by the fact that said second (34) and third (35) conveyor means comprise respective belts (32, 33) in turn comprising respective transportation branches (36, 37) located side by side and coplanar with each other; the transportation branch (37) of said third conveyor means (35) extending through a gumming station (49) housing said gumming means (75; 80).

20. A machine as claimed in claim 19, characterized by the fact that said gumming means (75) comprise a spray nozzle (76) associated with said third conveyor means (35) and moving back and forth in a direction (77) perpendicular to the plane of said transportation branches (36, 37).

21. A machine as claimed in claim 19, characterized by the fact that said gumming means (80) comprise a lobed wheel (84) located beneath the transportation branch (36) of said second conveyor means (34), and having a number of peripheral gumming pads (86) cooperating successively with a gumming roller (82) and with the end wall of the packets (3*b*) on said third conveyor means (35).

22. A machine as claimed in claim 9, characterized by the fact that it also comprises push means (66) for feeding each double packet (2) from said compacting means (51) in said second direction (38) and into a respective seat (67) on an overwrapping wheel (68).

* * * * *